US006050720A

United States Patent [19]

Tuyuki

[11] Patent Number: 6,050,720

[45] Date of Patent: Apr. 18, 2000

[54] STIRRING APPARATUS WITH COAXIAL STIRRING IMPELLERS

[75] Inventor: Isao Tuyuki, Kanagawa, Japan

[73] Assignee: Fuji Photo Film Co., Ltd., Kanagawa, Japan

[21] Appl. No.: 09/134,038

[22] Filed: Aug. 14, 1998

[30] Foreign Application Priority Data

Sep. 4, 1997 [JP] Japan ..... 9-239893

[51] Int. Cl.[7] ..... B01F 5/10; B01F 7/22

[52] U.S. Cl. ..... 366/264; 366/270; 366/296; 422/227

[58] Field of Search ..... 422/224, 225, 422/226, 227, 228, 231; 366/262–265, 270, 293–296

[56] References Cited

U.S. PATENT DOCUMENTS

| | | | |
|---|---|---|---|
| 614,522 | 11/1898 | Whiting et al. | 366/296 |
| 2,209,287 | 7/1940 | Simpson . | |
| 2,385,128 | 9/1945 | Castner . | |
| 2,438,204 | 3/1948 | Castner | 366/293 |
| 2,668,694 | 2/1954 | Kline et al. | 366/294 |
| 2,801,083 | 7/1957 | Balassa . | |
| 3,782,697 | 1/1974 | Karg . | |
| 3,785,777 | 1/1974 | Porter et al. . | |
| 3,984,001 | 10/1976 | Nagano et al. | 366/293 |
| 4,289,733 | 9/1981 | Saito et al. . | |
| 4,454,077 | 6/1984 | Litz | 366/295 |

FOREIGN PATENT DOCUMENTS

| | | | |
|---|---|---|---|
| 55-10545 | 3/1980 | Japan . | |
| 64-47432 | 2/1989 | Japan | 366/296 |

*Primary Examiner*—Charles E. Cooley
*Attorney, Agent, or Firm*—Sughrue, Mion, Zinn, Macpeak & Seas, PLLC

[57] ABSTRACT

The first agitating impeller and the second agitating impeller, which are arranged in the addition solution mixing chamber dipped in the primary component solution stored in the reaction vessel, are rotated independently from each other in the reverse direction, so that the generation of vortexes is suppressed.

4 Claims, 3 Drawing Sheets

STIRRING APPARATUS WITH COAXIAL STIRRING IMPELLERS

BACKGROUND OF THE INVENTION

The present invention relates to a stirring apparatus for agitating and mixing solutions by a batch treatment. More particularly, the present invention relates to improvements for enhancing the treatment speed in an agitating and mixing treatment and also enhancing the treatment quality at the same time.

For example, a photographic silver halide emulsion, which is used as a photosensitive material, is made by agitating and mixing solutions in a batch treatment. This photographic emulsion of silver halide is formed when a water-soluble silver salt solution and a water-soluble halide solution, which are addition solutions, are added to a colloidal aqueous solution, which is a primary component solution, and the solutions are agitated and mixed with each other.

However, when the concentration of each addition solution is high in the agitating and mixing process, grains of silver halide formed in the process grow excessively and large grains are formed. When silver halide grains formed in the reaction of the addition solutions stay in the solution, uniform aging of the grains of silver halide is obstructed, and further it becomes impossible to form a photographic silver halide emulsion of uniform quality.

That is, the following are important in the stirring apparatus used for the formation of a photographic silver halide emulsion. The addition solution is instantaneously diluted, agitated and mixed, so that silver halide grains of small size can be formed. In order to uniformly, quickly disperse and ripen the thus formed silver halide grains in a colloidal aqueous solution which is a primary component solution, it is necessary to facilitate the circulation of the primary component solution.

In order to solve the above problems, the stirring apparatus shown in FIGS. 6 and 7 was proposed.

This stirring apparatus 1 was disclosed in the U.S. Pat. No. 4,289,733 which corresponds to the Examined Japanese Patent Publication No. Sho 55-10545 applied by the present applicant, which includes: a reaction vessel 4 for storing a colloidal aqueous solution 2 which is a primary component solution when a photographic emulsion of silver halide is produced; a mixing device 6, formed into a cylindrical shape, both ends of which are open, the mixing device 6 being arranged in the reaction vessel 4 so that it can be dipped in the colloidal aqueous solution 2; conduits 10, 11 for supplying a water-soluble silver salt solution and a water-soluble halide solution into the mixing device 6 from one opening 8 of the mixing device 6; and two agitator blades consisting of a lower agitator blade 13 and an upper agitator blade 17 which are rotated in the mixing device 6.

The mixing device 6 is arranged being dipped in the colloidal aqueous solution 2 in such a manner that openings of both ends of the mixing device 6 are set in the horizontal direction.

The lower agitator blade 13 is a paddle impeller and arranged at a position close to the lower end opening 8 of the mixing device 6 as shown in FIG. 7. When the lower agitator blade 13 is rotated round the central axis of the mixing device 6, a radial flow is formed which mainly flows in the circumferential and the radial direction of the mixing device 6, so that the solutions in the mixing device 6 can be agitated and mixed. Therefore, the addition solution is instantaneously diluted and then agitated and mixed. Due to the foregoing, silver halide grains of small grain size can be formed in the mixing device 6.

On the other hand, the upper agitator blade 17 is a jet impeller and arranged at a position close to the upper end opening 15 of the mixing device 6 as shown in FIG. 7. When the upper agitator blade 17 is rotated round the central axis of the mixing device 6, an axial flow is formed which flows along the axis of the mixing device 6 from the lower end opening 8 to the upper end opening 15 of the mixing device 6. The upper agitator blade 17 discharges the solution, which is agitated and mixed by the lower agitator blade 13, from the upper end opening 15 of the mixing device 6 to the outside of the mixing device 6. At the same time, the upper agitator blade 17 sucks the colloidal aqueous solution 2 from the outside of the mixing device 6 into the mixing device 6 via the lower end opening 8.

That is, the upper agitator blade 17 facilitates the circulation of the colloidal aqueous solution 2 in the reaction vessel 4 so that the silver halide grains formed by the lower agitator blade 13 can be quickly, uniformly dispersed and ripened in the colloidal aqueous solution (bulk liquid) 2 in the reaction vessel 4.

The lower agitator blade 13 and the upper agitator blade 17 are fixed to the same rotary shaft 19. The rotary shaft 19 is rotated by a motor 21 arranged on the cover 20 of the reaction vessel 4.

In this connection, the conduits 10, 11 supply the addition solutions into the opening 8 via supply holes 25, 26 arranged on the bottom wall 23 of the mixing device which forms the lower end opening 8 of the mixing device 6.

However, the following problems may be encountered when the above conventional stirring apparatus 1 is operated. The radial flow formed by the lower agitator blade 13 rotates the axial flow formed by the upper agitator blade 17 in the same direction. Therefore, vortexes are generated in the mixing device 6 and the reaction vessel 4, and air is involved in the vortexes and foam is made in the process of agitation. Therefore, it is impossible to circulate the colloidal aqueous solution 2 in the reaction vessel as desired. As a result, the silver halide grains can not be sufficiently dispersed and ripened in the bulk solution. Accordingly, there is a possibility that the treatment speed and the quality of treatment are deteriorated.

SUMMARY OF THE INVENTION

An object of the present invention is to solve the above problems. It is an object of the present invention to provide a stirring apparatus in which the primary component solution is stably circulated, so that the solution agitated and mixed by the first agitating impeller can be uniformly dispersed in the primary component solution. For example, an object of the present invention is to provide an agitator by which the treatment speed and the quality of treatment can be enhanced in the agitating and mixing process in which a photographic silver halide emulsion is produced.

The above object of the present invention can be accomplished by a stirring apparatus comprising: a reaction vessel in which a predetermined quantity of addition solution is added to and agitated with a primary component solution stored in the vessel; an addition solution mixing chamber formed into a cylindrical shape, both ends of which are open, arranged in the solution stored in the vessel; a first agitating impeller arranged on one opening side of the chamber, rotated round an axis of the direction of the opening of the chamber, the first agitating impeller generating a radial flow in the chamber which mainly flows in the circumferential and the radial direction of the chamber; and a second agitating impeller arranged on the other opening side of the chamber, rotated independently from the first impeller in a reverse direction round the axis of the direction of the opening of the chamber, the second agitating impeller generating an axial flow in the chamber which flows in the direction of the opening of the chamber.

In the above stirring apparatus, it is possible to compose the apparatus in such a manner that the rotary drive shaft of the first agitating impeller is arranged coaxially with the drive tube for rotating the second agitating impeller.

A position of the first impeller may be replaced with a position of the second impeller.

A paddle or turbine impeller may be used for the first agitating impeller, and a jet or propelling impeller may be used for the second agitating impeller. A jet impeller and a paddle impeller or two turbine impellers may be used for the second agitating impeller.

According to the above structure of the present invention, the first agitating impeller and the second agitating impeller, which are arranged coaxially with each other, are driven and rotated independently from each other in a reverse direction. Therefore, a radial flow formed by the first agitating impeller and a radial flow formed by the second agitating impeller, the direction of which is reverse to the direction of the radial flow formed by the first agitating impeller, are canceled by each other. Therefore, the radial flow formed by the first agitating impeller prevents an axial flow formed by the second agitating impeller from rotating in the same direction. For the above reasons, it is possible to prevent the generation of vortexes which tend to generate round the agitating shaft in the chamber and the reaction vessel. Therefore, the generation of foam can be prevented in the reaction process.

Accordingly, the addition solution is instantaneously diluted by the radial flow formed by the first agitating impeller and then agitated and mixed. At the same time, the second agitating impeller arranged coaxially with the first agitating impeller forms a predetermined stable axial flow without being affected by the radial flow formed by the first agitating impeller. Therefore, the primary component solution can be stably circulated by the action of the axial flow, and the solution agitated and mixed by the first agitating impeller can be uniformly dispersed in the primary component solution.

DETAILED DESCRIPTION OF THE PREFERRED EMBODIMENTS

The present invention will be explained below referring to an embodiment shown in the accompanying drawings.

Figure 1:
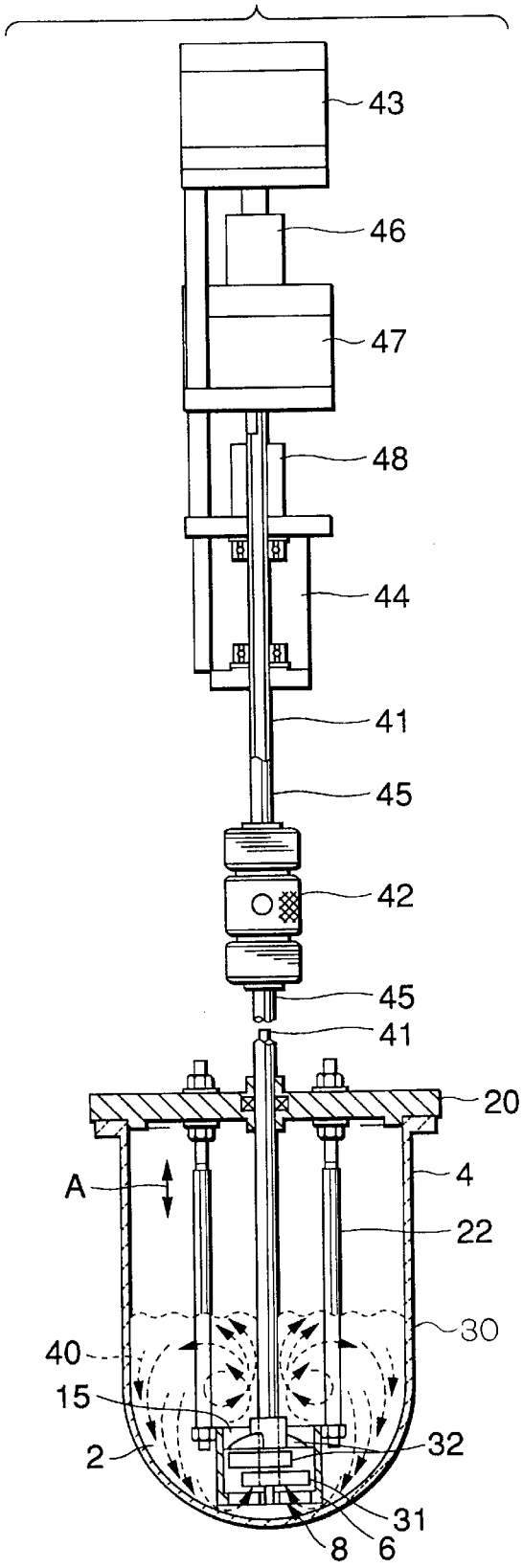
FIG. 1 is a cross-sectional front view of an embodiment of the stirring apparatus of the present invention.

FIG. 1 is a cross-sectional front view showing an outline of the structure of an embodiment of the stirring apparatus of the present invention.

Figure 6:
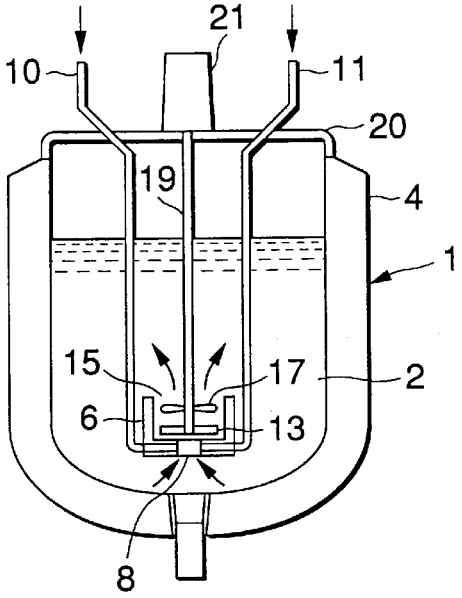
FIG.6 PRIOR ART
FIG. 6 is a cross-sectional front view showing an outline of the arrangement of the conventional stirring apparatus.
Figure 7:
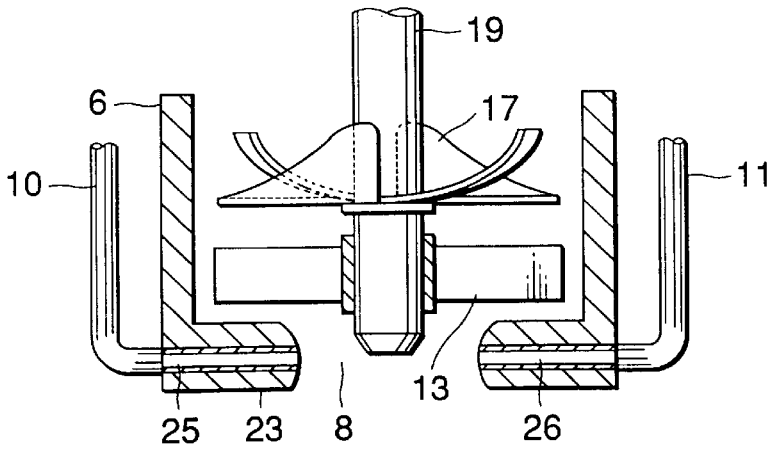
FIG.7 PRIOR ART
FIG. 7 is an enlarged cross-sectional front view showing a primary portion of the conventional stirring apparatus.

The stirring apparatus 30 of this embodiment is provided when the stirring apparatus 1 shown in FIGS. 6 and 7 is improved.

This is an embodiment of the stirring apparatus 30 used for producing a photographic silver halide emulsion. The stirring apparatus 30 includes: a reaction vessel 4 for storing a colloidal aqueous solution 2 which is a primary component solution when a photographic emulsion of silver halide is produced; an addition solution mixing chamber 6, formed into a cylindrical shape, both ends of which are open, the addition solution mixing chamber 6 being arranged in the reaction vessel 4 so that it can be dipped in the colloidal aqueous solution 2, the addition solution mixing chamber 6 being supported by a support shaft 22; and conduits for supplying a water-soluble silver salt solution and a water-soluble halide solution into the chamber 6 from one opening 8 of the chamber 6. The aforementioned structure is the same as the structure of the stirring apparatus 1 of the conventional apparatus described in the prior art.

Figure 2:
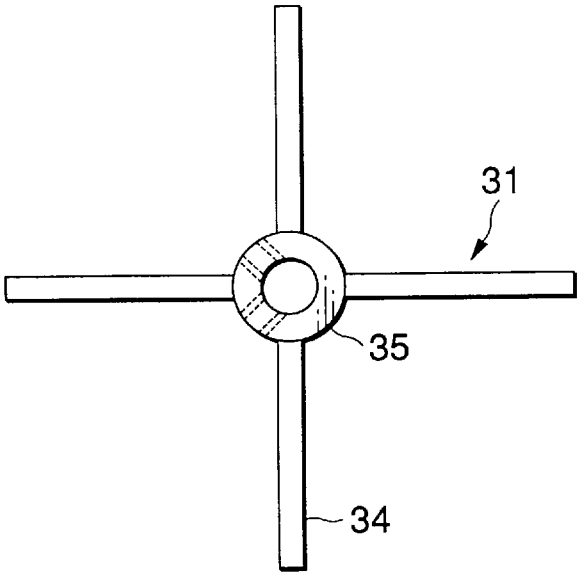
FIG. 2 is a plan view of the first agitating impeller used for the stirring apparatus of an embodiment of the present invention.
Figure 3:
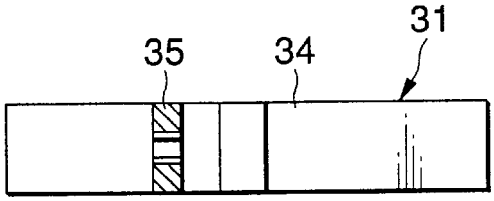
FIG. 3 is a front view of the first agitating impeller shown in FIG. 2.

The first agitating impeller 31 is a paddle impeller in which four flat plate-shaped blades 34 are arranged around the cylindrical boss 35 being formed into a cross as shown in FIGS. 2 and 3. The first agitating impeller 31 is arranged at a position close to the lower end opening 8 in the chamber 6. When the first agitating impeller 31 is rotated round the central axis of the chamber 6, a radial flow is formed mainly in the circumferential direction and the radial direction of the chamber 6. Therefore, a turbulent flow is facilitated for agitating the solutions in the chamber 6.

Figure 4:
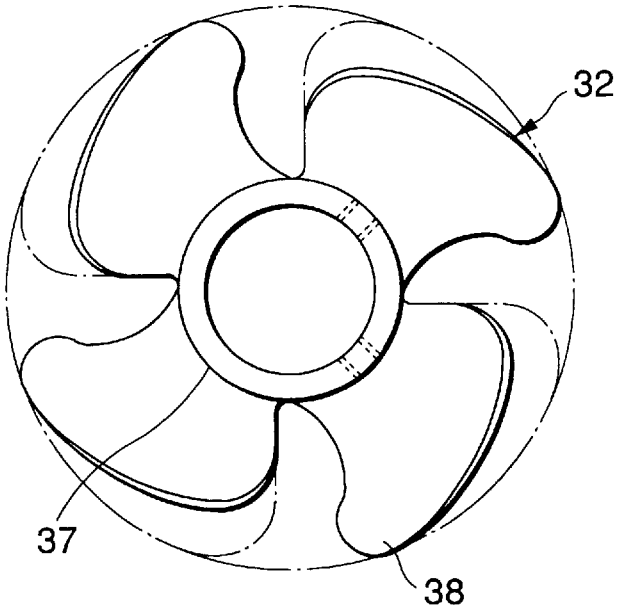
FIG. 4 is a plan view of the second agitating impeller used for the agitator of an embodiment of the present invention.
Figure 5:
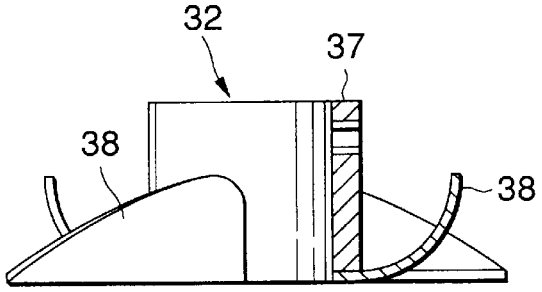
FIG. 5 is a front view of the second agitating impeller shown in FIG. 4.

On the other hand, as shown in FIGS. 4 and 5, the second agitating impeller 32 is a jet impeller in which four curved blades 38 for generating a thrust in the surrounding portion of the cylindrical boss 37 are arranged being formed into a cross. The second agitating impeller 32 is arranged at a position close to the upper end opening 15 in the chamber 6 and rotated round the central axis of the chamber 6. Due to the foregoing, an axial flow, which flows from the lower end opening 8 to the upper end opening 15 of the chamber 6, can be formed, and the solution agitated and mixed by the first agitating impeller 31 is discharged from the upper end opening 15 of the chamber 6 to the outside of the chamber 6. At the same time, the colloidal aqueous solution 2 is sucked from the outside of the chamber 6 into the chamber 6 via the lower end opening 8.

That is, the second agitating impeller 32 facilitates the circulation of the colloidal aqueous solution 2 in the reaction vessel 4 so that the silver halide grains formed by the first agitating impeller 31 can be quickly, uniformly dispersed and ripened in the colloidal aqueous solution (bulk liquid) 2 in the reaction vessel 4.

Concerning the second agitating impeller 32 shown in FIG. 1, there is arranged a paddle impeller, the shape of which is the same as that of the paddle impeller of the first agitating impeller 31. Due to the above arrangement, the agitating action can be further increased.

In this arrangement, the first agitating impeller 31 is fixed to a lower end of the inner shaft 41 which is vertically arranged on the central axis of the chamber 6. The inner shaft 41 is rotated counterclockwise by the first motor 43 arranged outside the reaction vessel 4.

The second agitating impeller 32 is fixed to a lower end of the cylindrical outer shaft 45 into which the inner shaft 41 is inserted in such a manner that the cylindrical outer shaft 45 and the inner shaft 41 can be rotated relatively to each other. The outer shaft 45 can be rotated clockwise by the second motor 47.

The first motor 43 and the second motor 47 are supported by a frame not shown via the bearing unit 44 and the couplings 46, 48 while the shafts of the motors are maintained at the center so that the outer and the inner shaft can be rotated coaxially with each other. Further, there is provided a tapered coupling 42 for connecting the inner shaft 41 and the outer shaft 45, which extend from the drive units, with the corresponding shafts in the reaction vessel.

Due to the above structure, the first agitating impeller 31 and the second agitating impeller 32 can be rotated independently from each other in the reverse direction.

The vertical position of the reaction vessel 4 with respect to the chamber 6 can be adjusted as shown by arrow (A) in FIG. 1.

In the combination of the agitating impellers described above, the radial flow formed by the first agitating impeller 31 and the radial flow formed by the rotation of the second agitating impeller 32 in the reverse direction are canceled by each other. Due to the foregoing, the solution agitated by the radial flow formed by the first agitating impeller 31 is discharged from the chamber 6 by the action of the axial flow formed by the second agitating impeller 32 while the condition of radial agitation conducted by the first agitating impeller 31 is somewhat maintained. Accordingly, concerning the flow of the solution in the entire reaction vessel 4, the solution is discharged from the upper portion of the chamber 6 in the state of a turbulent flow while vortexes are seldom generated. The thus discharged solution flows along the inner wall of the reaction vessel 4 and is sucked into the chamber 6 from a lower portion.

Accordingly, the addition solution is instantaneously diluted into the primary component solution by the action of the radial flow formed by the first agitating impeller and then agitated and mixed. At the same time, the second agitating impeller 32 arranged coaxially with the first agitating impeller forms a predetermined stable axial flow without being affected by the radial flow formed by the first agitating impeller 31. By the stable circulation 40 of the primary component solution formed by the axial flow, it is possible to uniformly disperse the solution, which is agitated and mixed by the first agitating impeller 31, in the primary component solution. For example, the treatment speed and the quality of treatment can be enhanced in the agitating and mixing process in which a photographic silver halide emulsion is produced.

When the radial flow components formed by the agitating impellers 31, 32 are canceled by each other, the generation of foam by the radial flows can be prevented. Since it is unnecessary to provide a foam removing process in the latter process, the productivity can be enhanced.

In this connection, the use of the stirring apparatus of the present invention is not limited to the production of a photographic silver halide emulsion, but it can be used for agitating and mixing various solutions.

In the above embodiment, the openings of the chamber 6 are formed in the vertical direction, however, it is possible to change the direction of the openings of the chamber 6 in accordance with the nature of the solution to be agitated and mixed.

Further, the positional relation of the first and the second agitating impeller may be changed with respect to the vertical direction.

Also, the paddle or the turbine impeller may be used for the first agitating impeller, and the jet or the propeller impeller may be used for the second agitating impeller.

Further, the jet and paddle impeller or two turbine impellers may be used for the second agitating impeller.

According to the agitator of the present invention, the first and the second agitating impeller, which are arranged coaxially with each other, are rotated independently from each other in the reverse direction. Therefore, the radial flow formed by the first agitating impeller and the radial flow formed by the second agitating impeller in the reverse direction are canceled by each other, so that the generation of vortexes can be suppressed.

Accordingly, the addition solution is instantaneously diluted by the radial flow formed by the first agitating impeller and then agitated and mixed. At the same time, the second agitating impeller arranged coaxially with the first agitating impeller forms a predetermined stable axial flow without being affected by the radial flow formed by the first agitating impeller. Therefore, the primary component solution can be stably circulated by the action of the axial flow, and the solution agitated and mixed by the first agitating impeller can be uniformly dispersed in the primary component solution. For example, in the production of a photographic silver halide emulsion, the treatment speed can be enhanced in the agitating and mixing process, and the quality of treatment can be enhanced at the same time.

What is claimed:

1. A stirring apparatus comprising:

a reaction vessel in which a predetermined quantity of addition solution is added to and agitated with a primary component solution stored in said reaction vessel;

an addition solution mixing chamber formed into a cylindrical shape, having an upper open end and a lower open end, and arranged in the solution stored in said reaction vessel;

a first agitating impeller arranged at said lower open end of said chamber, and rotated around an axis of a direction toward said upper open end of said chamber, said first agitating impeller being one of a paddle and turbine impeller for generating a radial flow in said chamber which mainly flows in a circumferential and a radial direction of said chamber; and a second agitating impeller arranged at said upper open end of said chamber, and rotated independently from said first impeller in a reverse direction round the axis of the direction toward said upper open end of said chamber, said second agitating impeller being one of a jet and propelling impeller for generating an axial flow in said chamber which flows in the direction toward said upper open end of said chamber;

wherein said first impeller and said second impeller act to prevent generation of a vortex in said chamber.

2. The stirring apparatus according to claim 1, wherein a rotary drive shaft of said first agitating impeller is coaxially rotated in a drive tube which rotates said second agitating impeller.

3. The stirring apparatus according to claim 1, wherein said first impeller is replaced with said second impeller.

4. The stirring apparatus according to claim 1, wherein one of a jet impeller and a paddle impeller, and two turbine impellers are used for said second agitating impeller.

* * * * *